US012654217B2

(12) United States Patent
Shores et al.

(10) Patent No.: US 12,654,217 B2
(45) Date of Patent: Jun. 16, 2026

(54) IRONING SYSTEMS AND METHODS

(71) Applicant: Novelis Inc., Atlanta, GA (US)

(72) Inventors: Jay Michael Shores, Alpharetta, GA (US); Carlos Nobrega, Woodstock, GA (US); Stewart Edward Hickey, Dallas, GA (US)

(73) Assignee: Novelis Inc., Atlanta, GA (US)

( * ) Notice: Subject to any disclaimer, the term of this patent is extended or adjusted under 35 U.S.C. 154(b) by 112 days.

(21) Appl. No.: 18/037,735

(22) PCT Filed: Dec. 14, 2021

(86) PCT No.: PCT/US2021/072900

§ 371 (c)(1),
(2) Date: May 18, 2023

(87) PCT Pub. No.: WO2022/133431

PCT Pub. Date: Jun. 23, 2022

(65) Prior Publication Data

US 2024/0001425 A1 Jan. 4, 2024

Related U.S. Application Data

(60) Provisional application No. 63/199,228, filed on Dec. 15, 2020.

(51) Int. Cl.
*B21D 22/28* (2006.01)

(52) U.S. Cl.
CPC ..... *B21D 22/28* (2013.01)

(58) Field of Classification Search
CPC ..... B21D 22/20; B21D 22/24; B21D 22/28; B21D 22/30; B21D 51/26
See application file for complete search history.

(56) References Cited

U.S. PATENT DOCUMENTS

| | | | | |
|---|---|---|---|---|
| 4,711,611 | A | 12/1987 | Bachmann et al. | |
| 4,779,442 | A | 10/1988 | Welsh | |
| 5,555,761 | A * | 9/1996 | Lavy | B21D 22/28 72/347 |
| 2009/0249856 | A1 | 10/2009 | Smyers et al. | |
| 2018/0207706 | A1 | 7/2018 | Swedberg | |

FOREIGN PATENT DOCUMENTS

| | | | |
|---|---|---|---|
| GB | 2141063 | A | 12/1984 |
| JP | 201 4083573 | A | 5/2014 |
| JP | 2019525844 | A | 9/2019 |

(Continued)

OTHER PUBLICATIONS

International Application No. PCT/US2021/072900, "International Search Report and Written Opinion", Mar. 28, 2022, 14 pages.

(Continued)

*Primary Examiner* — Teresa M Ekiert
(74) *Attorney, Agent, or Firm* — Kilpatrick Townsend & Stockton LLP

(57) ABSTRACT

An ironing system includes a ram, a sensor system, and a punch nose. The ram includes a ram body and a ram nose, and the ram includes an inner surface that defines an inner chamber. The punch nose is connected to the ram nose via the sensor, and the sensor is configured to detect a force on the punch nose during an ironing process. An adaptor may be coupled to the inner surface of the ram, and the adaptor may support the sensor on the ram body.

15 Claims, 4 Drawing Sheets

(56) References Cited

FOREIGN PATENT DOCUMENTS

| | | | |
|---|---|---|---|
| JP | 2020514068 | A | 5/2020 |
| JP | 2022510416 | A | 1/2022 |
| WO | 2020117641 | A1 | 6/2020 |

OTHER PUBLICATIONS

EP Application 21844585.6 , "Office Action", Apr. 25, 2024, 6 pages.
JP Application 2023-533673 , "Office Action", Jul. 9, 2024, 5 pages.
PCT/US2021/072900 , "International Preliminary Report on Patentability", Jun. 29, 2023, 10 pages.
Canadian Patent Application No. 3,204,308, "Office Action", Nov. 1, 2024, 4 pages.
Chinese Patent Application No. 202180084408.X, "Office Action", Apr. 10, 2025, 21 pages.
European Patent Application No. 21844585.6, "Intention to Grant", Oct. 23, 2024, 7 pages.
European Patent Application No. 21844585.6, "Office Action", Mar. 3, 2025, 5 pages.
Japanese Patent Application No. 2023-533673, "Notice of Decision to Grant", Dec. 3, 2024, 3 pages.
Vietnamese Patent Application No. 1-2023-03406, "Office Action", Mar. 31, 2025, 2 pages.
Korean Patent Application No. 10-2023-7017802, "Office Action", Jun. 20, 2025, 14 pages.
European Patent Application No. 21844585.6, "Intention to Grant", Aug. 29, 2025, 6 pages.
Canadian Patent Application No. 3,204,308, "Notice of Allowance", Sep. 23, 2025, 1 page.
Chinese Patent Application No. 202180084408.X, "Notice of Decision to Grant", Jan. 6, 2026, 7 pages.
Korean Patent Application No. 9-5-2026-023097083, "Notice of Allowance", Mar. 9, 2026, 6 pages.
Mexican Patent Application No. MX/A/2023/006789 , "Office Action", Feb. 25, 2026, 8 pages.

* cited by examiner

IRONING SYSTEMS AND METHODS

CROSS-REFERENCE TO RELATED APPLICATIONS

This application claims the benefit of and priority to U.S. Provisional Application No. 63/199,228, filed Dec. 15, 2020, which is hereby incorporated by reference in its entirety.

FIELD OF THE INVENTION

This application generally relates to metalworking techniques, and, more particularly, to improved systems and methods for ironing.

BACKGROUND

Many cans or cylindrical articles such as food and drink cans, fire extinguishers, gas cans, oil filter casings, damper casings, and many other types of articles, are made from metal materials such as aluminum, aluminum alloys, stainless steels, brass, low-carbon steel, and various other suitable materials. The process of forming the can or cylindrical article from the metal material generally includes making a blank out of the metal material and then drawing the blank to form a shallow cup. After the shallow cup is initially drawn, it may be redrawn to reduce its diameter and deepen the cup. The cup is then ironed to reduce the wall thickness to ultimately provide the body for the can or cylindrical article. Ironing generally includes axially driving the metal material through one or more ironing dies to reduce the wall thickness with an ironing system having a ram and a punch. Various forces can be applied to the punch, ironing die, and/or metal material during ironing, and these forces may correlate to various factors that can be controlled during ironing. However, existing ironing systems including force sensors are unreliable and experience premature failures. The force sensors are typically difficult to service, resulting in increased costs and delays in processing.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to various examples, an ironing system includes a ram and a sensor system. The ram includes a ram body and a ram nose, and the ram also includes an inner surface defining an inner chamber. The sensor system includes a sensor and an adaptor. The sensor is configured to detect a force during an ironing process, and the adaptor is coupled to the inner surface of the ram and supports the sensor on the ram body.

According to certain examples, an ironing system includes a ram, a punch, and a sensor system. The ram includes a ram body and a ram nose, and the punch includes a punch nose and a punch sleeve. In various embodiments, the punch nose is configured to engage a metal blank during an ironing process. The sensor system includes a sensor coupled to the punch nose, and the sensor is configured to detect a force on the punch nose during the ironing process.

According to some examples, an ironing system includes a ram, a punch nose, and a sensor system. The ram includes a ram body and a ram nose, and the ram also includes an inner surface defining an inner chamber. The sensor system includes a sensor, and the punch nose is connected to the inner surface of the ram nose via the sensor. In various embodiments, the sensor is configured to detect a force on the punch nose during an ironing process.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "bottom," "left," "right," "front," and "back," among others, are intended to refer to the orientation as illustrated and described in the figure (or figures) to which the components and directions are referencing.

Figure 1:
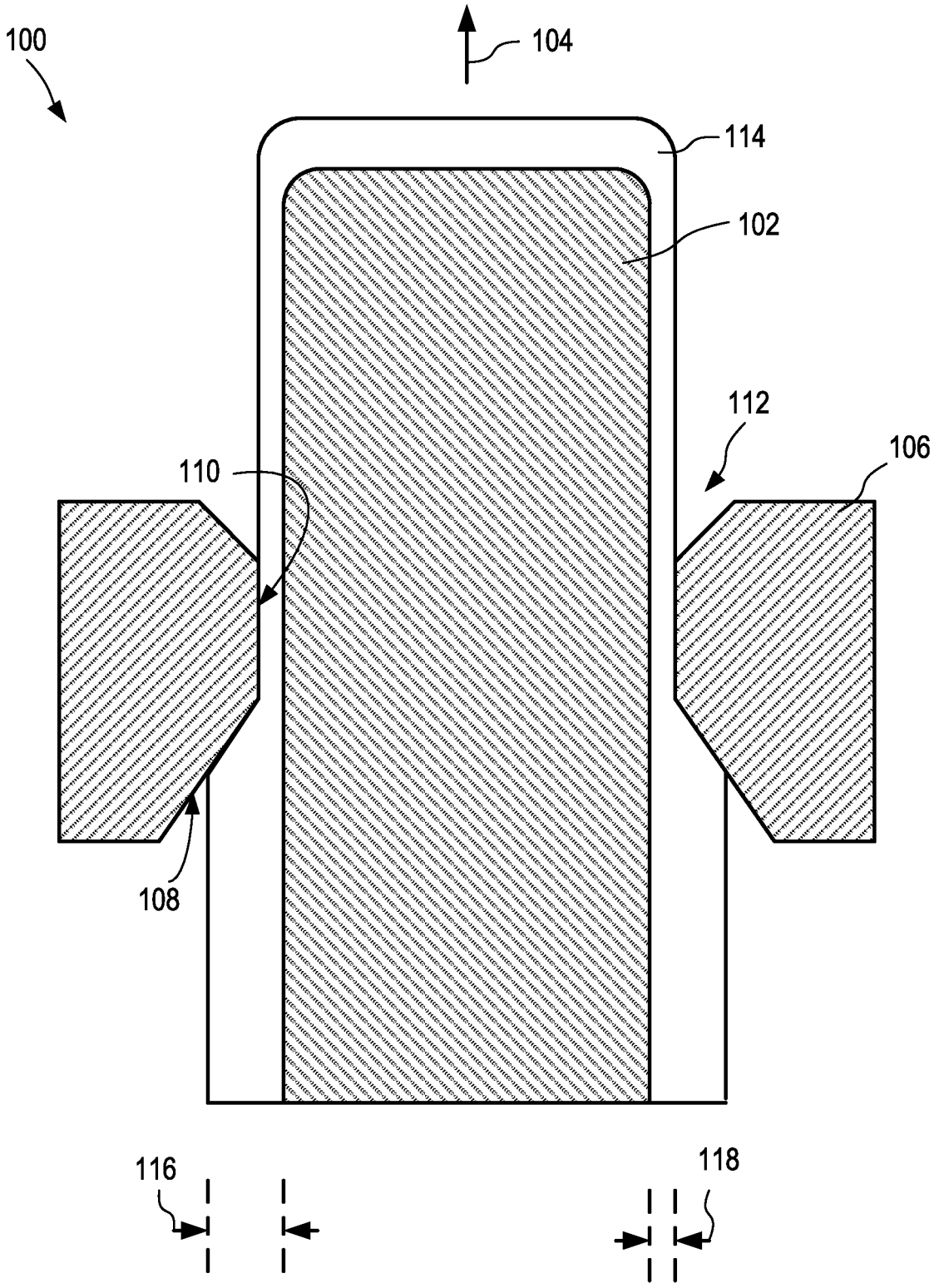
FIG. 1 is a view of a portion of an ironing system according to aspects of the current disclosure.
Figure 2:
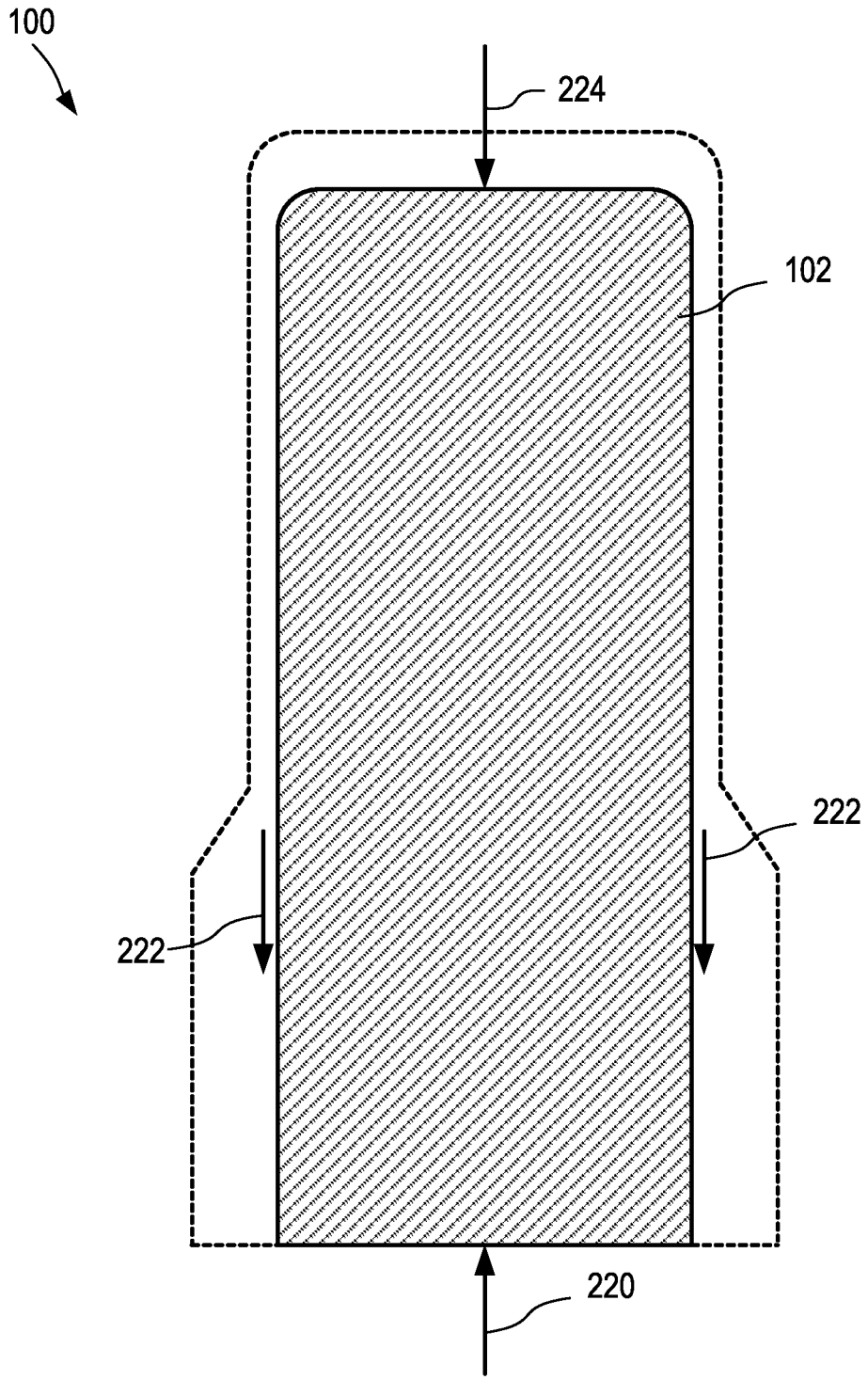
FIG. 2 illustrates forces on a punch of the ironing system of FIG. 1 during ironing.

FIGS. 1 and 2 illustrate a portion of an ironing system 100 according to certain aspects of the present disclosure. The ironing system 100 includes a punch 102, a ram assembly (not shown in FIG. 1) that drives the punch 102 in an axial direction 104, and at least one ironing die 106. As illustrated in FIG. 1, the ironing die 106 includes an entry surface 108 and an inner surface 110. The inner surface 110 defines an opening or gap 112. During ironing, the punch 102 drives a metal article 114 through the gap 112 of the ironing die 106 in the axial direction 104 such that the sidewalls of the metal article 114 are ironed from an initial thickness 116 to an end thickness 118. The ironing process may be repeated as many times as desired (and with as many types of ironing dies as desired) to produce a body having a desired wall thickness.

FIG. 2 illustrates an example of some of the forces on the punch 102 during ironing. A total forming force 220 is the force that is applied by the punch 102 (through the ram assembly) onto the metal article during ironing. The total forming force 220 generally represents the sum of a friction force 222 between the punch 102 and the sidewalls of the metal article and a punch nose force 224 between the punch 102 and the bottom of the metal article. The punch nose force 224 represents a tensile force within a wall of the metal article. In some cases, the total forming force 220 is measured on the ram assembly itself, on a die, on a die holder, and/or on a bolster plate.

FIGS. 3-7 illustrate portions of another ironing system 300 according to aspects of the present disclosure. The ironing system 300 includes a punch 302, a ram assembly 326, and a sensor system 348. In various embodiments, and as discussed in detail below, the sensor system 348 includes a sensor 350 and an adaptor 352 that at least partially supports the sensor 350 relative to the ram assembly 326.

Figure 3:
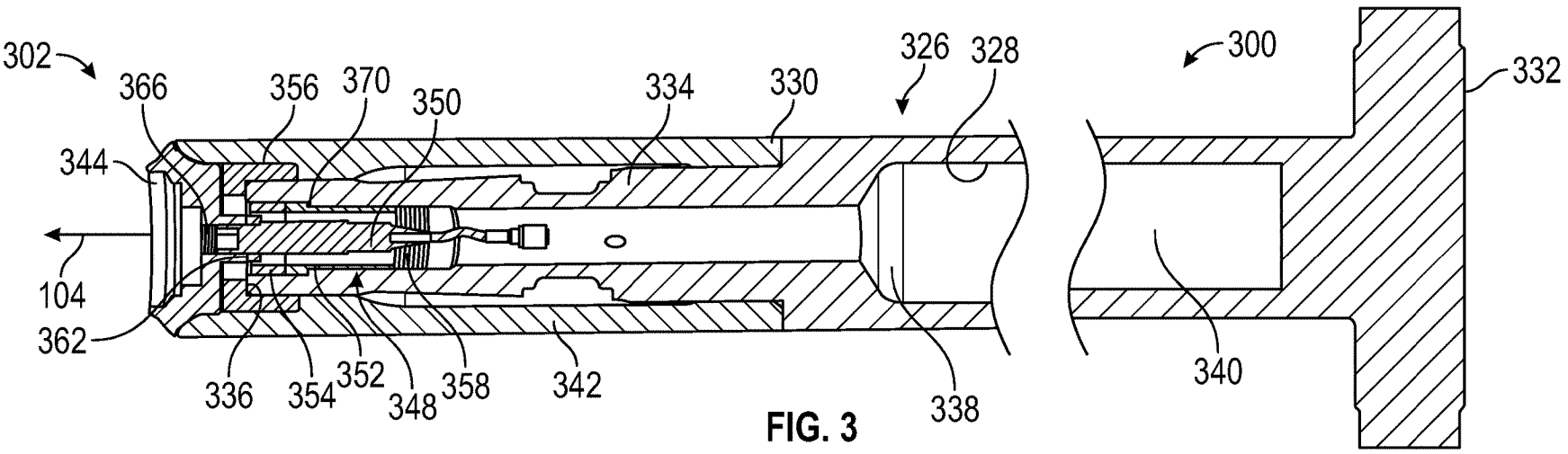
FIG. 3 is a view of a portion of an ironing system according to aspects of the current disclosure.
Figure 4:
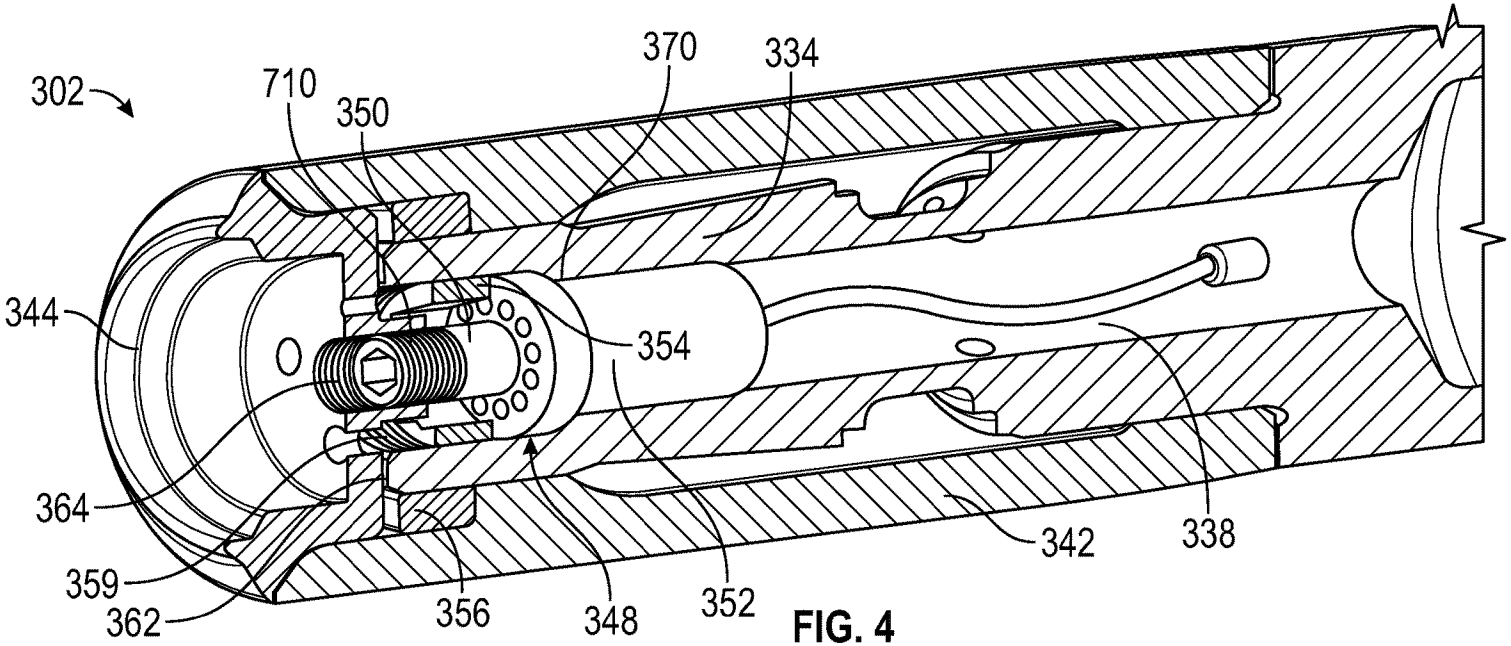
FIG. 4 is another view of a portion of the ironing system of FIG. 3.
Figure 5:
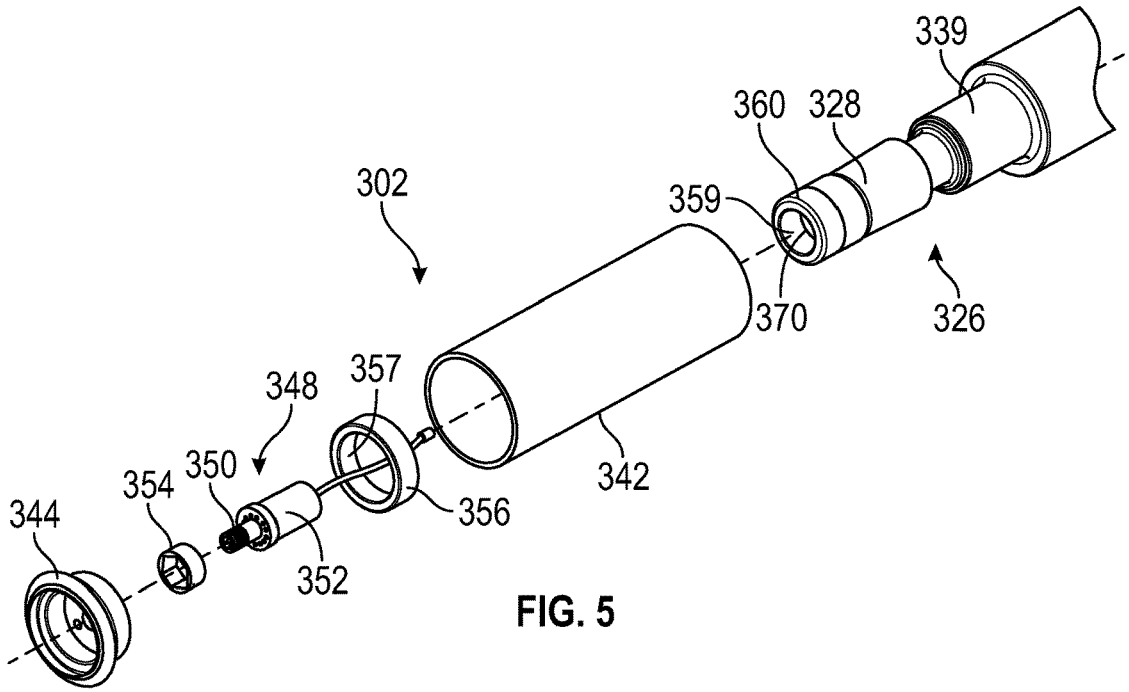
FIG. 5 is an exploded view of a portion of an ironing system according to aspects of the current disclosure.

As best illustrated in FIGS. 3-5, the ram assembly 326 includes a ram body 328 having a front end 330 and a back end 332. A ram nose 334 extends from the front end 330 of the ram body 328 and terminates at a ram nose end 336. In various aspects, a diameter of the ram nose 334 is less than the diameter of the ram body 328. The ram assembly 326 is driven in the axial direction 104 by an actuator during the ironing process to form the metal article into a cup. In some examples, the actuator is a linear actuator, although it need not be in other examples. The ram assembly 326 is driven at any suitable speed to produce a desired number of cups per minute. As some non-limiting examples, the ram assembly 326 may be driven at speeds of appropriately 400-450 strokes per minute, where one stroke refers to one cycle of engaging, forming, and releasing one cup. In other words, at 200-450 strokes per minute, the assembly engages, forms, and releases cups at a rate of about 200-450 strokes per minute.

As best illustrated in FIG. 3, the ram assembly 326 includes an inner surface 338 that defines an inner chamber 340. The inner chamber 340 optionally extends to the ram nose end 336, although it need not in other examples. The inner diameter of the inner chamber 340 need not be the same along the length of the ram body 328. As a non-limiting example, in FIGS. 3-*a* first portion of the inner chamber 340 between the back end 332 and the ram nose end 336 has a largest inner diameter, a second portion of the inner chamber 340 between the first portion and the ram nose end 336 has a smallest inner diameter, and a third portion of the inner chamber 340 between the second portion of the inner chamber 340 and the ram nose end 336 has an intermediate inner diameter that is greater than the diameter of the second portion but less than the diameter of the first portion. In certain embodiments, the inner chamber 340 has inner diameters such that a shoulder 370 is defined by the inner surface 338. In other embodiments, the inner chamber 340 may have various other profiles, inner diameters or combinations of inner diameters as desired.

In some embodiments, the inner surface 338 of the ram assembly 326 includes a first ram coupling feature 358 (see FIG. 3) for connecting the adaptor 352 with the ram assembly 326 and/or a second ram coupling feature 359 (see FIGS. 4 and 5) for connecting an adaptor nut 354 with the ram assembly 326. In various embodiments, the first ram coupling feature 358 and the second ram coupling feature 359 are provided on portions of the inner surface 338. The first ram coupling feature 358 and the second ram coupling feature 359 may be various suitable coupling devices or features for connecting the adaptor nut 354 and adaptor 352, respectively, with the ram assembly 326. The type of coupling feature utilized as the first ram coupling feature 358 need not be the same as the type of coupling feature utilized as the second ram coupling feature 359. In the embodiment of FIGS. 3-5, the first ram coupling feature 358 and the second ram coupling feature 359 are both threading. In other embodiments, the first ram coupling feature 358 may be omitted, and the adaptor 352 may not be directly coupled to the inner surface 338 (e.g., only the second ram coupling feature 359 is utilized). In yet other embodiments, the second ram coupling feature 359 may be omitted (as well as the adaptor nut 354), and the adaptor 352 may be directly connected to the ram assembly 326 via the first ram coupling feature 358.

As best illustrated in FIG. 5, in various embodiments, an outer surface 339 of the ram body 328 may optionally include an outer ram coupling feature 360 on at least a portion of the outer surface 339. The outer ram coupling feature 360 may selectively engage a punch sleeve retention nut 356. The outer ram coupling feature 360 may be various suitable features or mechanisms for engaging and connecting the punch sleeve retention nut on the ram body 328. In the embodiment of FIGS. 3-7, the outer ram coupling feature 360 is threading.

In certain examples, the ram assembly 326 optionally includes a pressure system that maintains a constant pressure within the inner chamber 340 such that coolant and/or moisture inside the ram body 328 is minimized and/or reduced. As one non-limiting example, the pressure system may maintain a pressure of approximately 1-20 PSI within the inner chamber 340, such as approximately 5-10 PSI within the inner chamber 340, although in other examples, other pressures may be maintained. By minimizing and/or reducing coolant or moisture within the inner chamber 340, the potential for the sensor 350 to short circuit is minimized and/or reduced.

The punch 302 includes a punch sleeve 342 and a punch nose 344. As best illustrated in FIGS. 3 and 4, the punch sleeve 342 is supported on the ram nose 334 between the punch nose 344 and the ram body 328, and in various embodiments, the punch sleeve 342 abuts the ram body 328 at the front end 330. In some examples, and in the embodiment of FIGS. 3-7, the punch sleeve 342 and the punch nose 344 are separate components such that the punch nose 344 is movable relative to the punch sleeve 342. In other examples, the punch sleeve 342 and the punch nose 344 are formed as a single or monolithic component.

As illustrated in FIGS. 3-5, in various embodiments, the punch sleeve retention nut 356 may couple the punch sleeve 342 to the ram assembly 326. In certain embodiments, the punch sleeve retention nut 356 includes a coupling feature 357 that is complimentary to the outer ram coupling feature 360. In the embodiment of FIGS. 3-7, the coupling feature 357 is threading that is complimentary to the threading of the outer ram coupling feature 360. As best illustrated in FIGS. 3-5, the punch sleeve retention nut 356 may engage the ram assembly 326 (via the coupling feature 357) to join the punch sleeve retention nut 356 with the ram assembly 326. In various embodiments, the punch sleeve retention nut 356 is engaged with the ram assembly 326 such that the punch sleeve retention nut 356 captures a portion of the punch sleeve 342 between the punch sleeve retention nut 356 and the front end 330 of the ram body 328.

The punch nose 344 includes a nose coupling feature 364 that may selectively couple the punch nose 344 with the sensor 350. The nose coupling feature 364 may be centered on the punch nose 344, although it need not be centered in other embodiments. In the embodiment illustrated, the nose coupling feature 364 is a projection that extends towards the ram body 328 when the punch nose 344 is assembled, and the projection defines an aperture with threading. In other embodiments, the nose coupling feature 364 may include various other structures and/or coupling devices for connecting the sensor 350 with the punch nose 344. In certain embodiments, and as discussed in detail below, the punch nose 344 may be coupled to the sensor 350 such that a gap 362 is maintained between the punch nose 344 and the punch sleeve 342. In some embodiments, the nose coupling feature 364 may allow for the punch nose 344 to be connected to the sensor 350 such that the gap 362 has a desired gap size and/or to maintain the gap 362 during processing. In other embodiments, a spacer may be positioned between the punch nose 344 and the ram nose 334 to define the gap 362 between the punch nose 344 and the punch sleeve 342. The punch nose 344 optionally includes one or more passages 620 (best illustrated in FIG. 6) that allow for air flow through the punch nose 344 to aid in removing the metal article from the punch sleeve 342.

In various aspects, the gap 362 may be intentionally provided between the punch nose 344 and the punch sleeve 342. In certain aspects, under force, the gap allows for the punch nose 344 to move relative to the punch sleeve 342. In various embodiments, this motion may cause a strain or deflection of the sensor 350, and the strain may be measured as force. The gap 362 between the punch nose 344 and the punch sleeve 342 may be adjustable to control a size of the gap, and the size of the gap 362 may be set such that there is motion between the punch nose 344 and the punch sleeve 342 under certain forces and such that motion is prevented or limited between the punch nose 344 and the punch sleeve 342 under other forces. In other words, the gap 362 may provide an adjustable force limit on the sensor 362. In one non-limiting example, the gap 362 may allow for motion between the punch nose 344 and the punch sleeve 342 for forces less than or equal to 10,000 lbs., although in other embodiments the force limit may be greater than or less than 10,000 lbs. In situations where forces are below the force limit, the sensor 350 may see the corresponding strain and provide a force measurement. In situations where the force exceeds the force limit, the punch nose 344 may run out of space to travel and bottom out on the punch sleeve 342, and there may be no more motion on the punch nose 344 and the sensor 342 may not see additional strain or force. As such, the gap 362 may be adjusted such that a range of forces may be measured (e.g., up to the force limit) while minimizing the effect on the sensor 342 (e.g., overloading) at forces above the force limit. As one non-limiting example, the gap 362 may allow for accurate measurements between the punch nose and the punch sleeve during ironing while without overloading the sensor during a doming operation.

Figure 6:
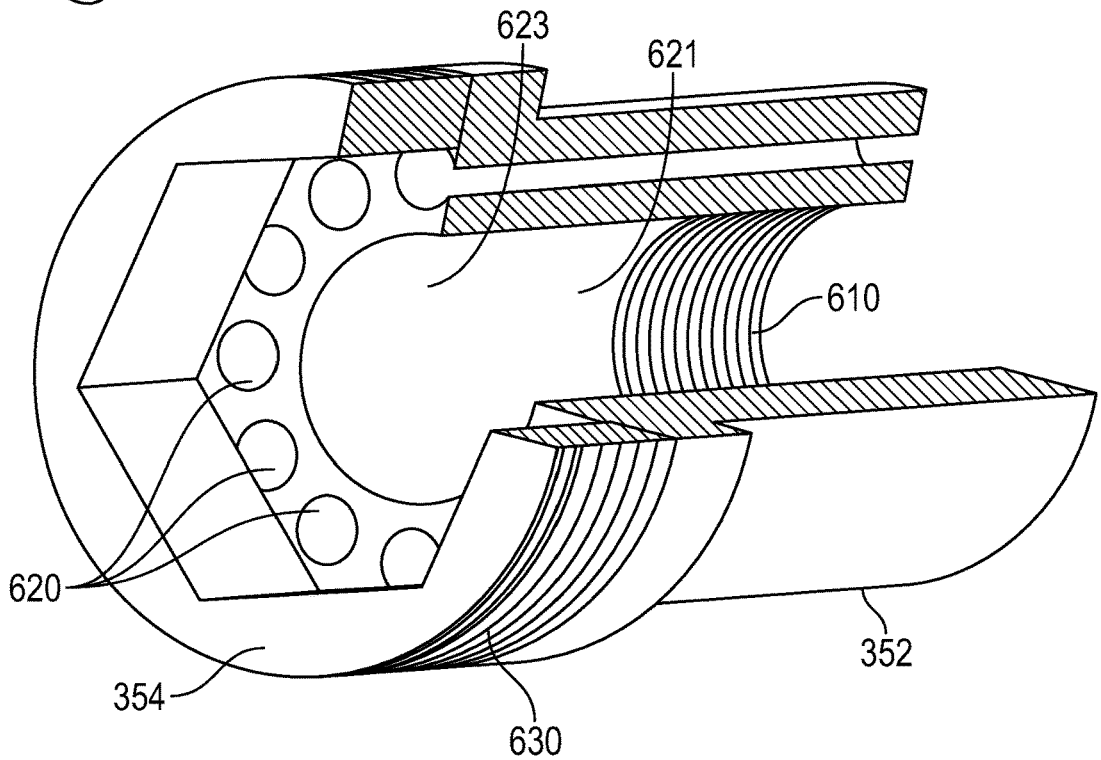
FIG. 6 is a view of an adaptor of an ironing system according to aspects of the current disclosure.

As previously mentioned, the sensor system 348 includes the sensor 350 and the adaptor 352. As best illustrated in FIGS. 3-6, in various embodiments, the adaptor 352 can couple the sensor 350 to the inner surface 338 of the ram body 328. In some embodiments, the sensor system 348 includes the adaptor nut 354 that secures the adaptor 352 relative to the ram assembly 326. As best illustrated in FIG. 6, the adaptor nut 354 includes a coupling feature 630 that is complimentary to the second ram coupling feature 359 such that the adaptor nut 354 can engage the second ram coupling feature 359 and retain a portion of the adaptor 352 between the adaptor nut 354 and the shoulder 370. In the embodiment of FIGS. 3-7, the coupling feature 630 includes threading that is complimentary to the threading of the second ram coupling feature 359. In various embodiments, the retention of the portion of the adaptor 352 between the adaptor nut 354 and the shoulder 370 may position the adaptor 352 relative to the ram assembly 326.

As best illustrated in FIG. 6, the adaptor 352 includes a central aperture 621 that selectively receives the sensor 350. The central aperture 621 has an inner surface 623, and in various embodiments, at least a portion of the inner surface 623 includes an adaptor coupling feature 610 that selectively engages the sensor 350 (discussed in detail below). Similar to the other coupling features discussed herein, the adaptor coupling feature 610 may be various suitable devices or mechanisms for coupling the sensor 350 with the adaptor 352. In the embodiment of FIGS. 3-6, the adaptor coupling feature 610 includes threading.

In addition to the central aperture 621, the adaptor 352 may also include one or more passages 620 that extends along a length of the adaptor 352. The number, shape, or size of the passages 620 should not be considered limiting. In various embodiments, the one or more passages 620 may allow for air flow through the adaptor 352 and/or around the sensor 350. In some embodiments, the air flow through the passages 620 may provide a positive pressure that may be used to remove the metal article off the punch sleeve 342 after forming.

Figure 7:
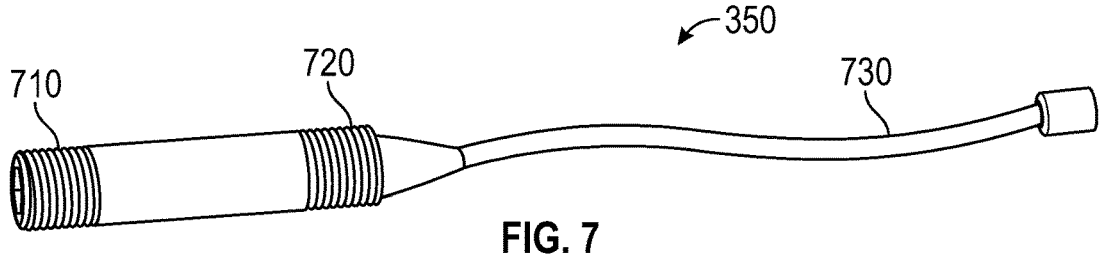
FIG. 7 is a view of a sensor of an ironing system according to aspects of the current disclosure.

As illustrated in FIGS. 3-7, the sensor 350 may be supported by the adaptor 352 within the ram body 328. As best illustrated in FIGS. 4, 5, and 7, in various examples, the sensor 350 is supported by the adaptor 352 on the ram assembly 326 such that it does not interfere with regular operation of the ram assembly 326 at high speeds or other operating conditions. In some optional examples, the adaptor 352 may center the sensor 350 within an inner diameter of the ram body 328, although it need not be centered within the inner diameter in other examples.

In various embodiments, the sensor 350 is configured to detect the amount of the punch nose force 224, which represents a tensile force on a sidewall of a metal article (e.g., can) formed from a metal blank. The sensor 350 may be a load cell or various other sensors suitable for measuring forces of the ironing system 300 during ironing as desired. The sensor described herein is not intended to require a particular structure or type of sensor and the sensor 350 may have various structures and/or be various types of sensors as desired. In certain embodiments, the sensor 350 may be communicatively connected to a controller or other suitable device that may use the force data to determine the forces that occur during ironing and/or otherwise utilize the data provided by the sensor 350. In some cases, additional sensors can be used to measure other aspects of the ironing system as desired.

In certain embodiments, and as best illustrated in FIG. 7, the sensor 350 may include a first sensor coupling feature 710 for selectively coupling the sensor 350 to a punch nose 344 (see, e.g., FIG. 3) and/or a second sensor coupling feature 720 for selectively coupling the sensor 350 to the adaptor 352 (see, e.g., FIG. 3). In various embodiments, the first sensor coupling feature 710 is complimentary to a corresponding coupling feature on the punch nose 344 and/or the second sensor coupling feature 720 is complimentary to the adaptor coupling feature 610. Similar to the other coupling features discussed herein, the first sensor coupling feature 710 and/or the second sensor coupling feature 720 may be various suitable devices or mechanisms for coupling the sensor 350 with the adaptor 352 and/or the punch nose 344, and the type of coupling mechanism of the first sensor coupling feature 710 need not be the same as the type of coupling mechanism of the second sensor coupling feature 720. In the embodiment of FIGS. 3-7, the first sensor coupling feature 710 and the second sensor coupling feature 720 each include threading. A cable 730 or wiring of the sensor 350 can run through the inner diameter of the ram body 328 (FIG. 3) and communicatively connect the sensor 350 to a controller or other suitable device that may utilize the force data detected by the sensor 350. The cable 730 may exit the ram assembly 326 at various locations as desired, including but not limited to through the back end 332.

The sensor 350 may be coupled to the punch nose 344 by engaging the first sensor coupling feature 710 with the nose coupling feature 364. As previously mentioned, in certain embodiments, the punch nose 344 may be coupled to the sensor 350 such that the gap 362 is maintained between the punch nose 344 and the punch sleeve 342. In these embodiments, the gap 362 may allow for the sensor 350 to detect and/or read the punch nose force 224 on the punch nose 344. Moreover, in some embodiments, the connection between the punch nose 344 and the sensor 350 allows for the gap 362 to be set as desired and/or to maintain the gap 362.

Referring to FIGS. 3-7, a method of assembling the ironing system 300 may include coupling the sensor 350 with the adaptor 352. In some embodiments, coupling with the sensor 350 with the adaptor 352 includes engaging the second sensor coupling feature 720 with the adaptor coupling feature 610.

The method may also include positioning and securing the adaptor 352 on the ram body 328. Positioning the adaptor 352 on the ram body 328 may include inserting the adaptor 352 into the inner chamber 340 of the ram body 328. Securing the adaptor 352 may include positioning the adaptor nut 354 in the inner chamber 340 and engaging the coupling feature 630 with the second ram coupling feature 359 such that a portion of the adaptor 352 is retained between the adaptor nut 354 and the shoulder 370. Additionally or alternatively, securing the adaptor 352 may include engaging the adaptor 352 with the first ram coupling feature 358.

In various embodiments, the method also includes positioning the punch sleeve 342 on the ram nose 334. The method may include securing the punch sleeve 342 relative to the ram nose 334 by engaging the coupling feature 357 of the punch sleeve retention nut 356 with the outer ram coupling feature 360 such that the punch sleeve retention nut 356 captures a portion of the punch sleeve 342 between the punch sleeve retention nut 356 and the front end 330 of the ram body 328.

The method may include assembling the punch nose 344 with the ram assembly 326 by engaging the nose coupling feature 364 of the punch nose with the first sensor coupling feature 710 of the sensor 350. In various embodiments, assembling the punch nose 344 may include defining the gap 362 between the punch nose 344 and the punch sleeve 342.

During ironing, the punch nose 344 engages the bottom of the metal article and receives the punch nose force 224. In certain examples, the sensor 350 may transmit the data in real time; however, in other examples, the sensor 350 may transmit the data at predetermined time intervals.

Through the ironing system 300, the punch nose force 224 can be directly measured. In certain aspects, based on the measured punch nose force 224, various aspects of the ironing system 300 can be controlled to control the ironing process. For example, in some cases, a type of metal used for the metal article, various surface characteristics of the punch 304 and/or the metal article, a type of lubrication used, a design of the ram, punch, or ironing die, a machine speed, or various other aspects of the ironing system 300 may be controlled based on the detected forces. As one example, a higher punch nose force 224, correlating to a higher tensile force on the sidewall of the metal article during ironing, may directly correlate with an increased likelihood of defects, or "tear offs." In some cases, based on the detected punch nose force 224, various aspects of the ironing system 300 may be controlled to reduce the incidence of tear offs, control redraw forces, monitor and control wear on dies, control formation of wrinkles, monitor and control lubrication deficiencies, monitor and control punch through or other types of defects, etc. In some cases, the forces detected by the sensors 350 may be used to regulate process parameters to reduce operating costs and/or to improve production efficiency. As a non-limiting example, a lower detected force may indicate an opportunity to decrease an amount of lubrication and/or increase speed to reduce operating costs, and a higher force may indicate that dies are worn out to reduce or avoid down time.

A collection of exemplary embodiments are provided below, including at least some explicitly enumerated as "Illustrations" providing additional description of a variety of example embodiments in accordance with the concepts described herein. These illustrations are not meant to be mutually exclusive, exhaustive, or restrictive; and the disclosure not limited to these example illustrations but rather encompasses all possible modifications and variations within the scope of the issued claims and their equivalents.

Illustration 1. An ironing system comprising: a ram comprising a ram body and a ram nose, wherein the ram comprises an inner surface defining an inner chamber; and a sensor system comprising: a sensor, wherein the sensor is configured to detect a force during an ironing process; and an adaptor coupled to the inner surface of the ram, wherein the adaptor supports the sensor on the ram body.

Illustration 2. The ironing system of any preceding or subsequent illustrations or combination of illustrations, wherein the adaptor comprises a central aperture and a plurality of passages surrounding the central aperture, wherein the sensor is supported in the central aperture of the adaptor, and wherein each of the plurality of passages extends along a length of the adaptor.

Illustration 3. The ironing system of any preceding or subsequent illustrations or combination of illustrations, further comprising a punch supported on the ram nose, wherein the punch comprises a punch nose and a punch sleeve, wherein the punch nose is configured to engage a metal blank during processing, and wherein the punch sleeve is supported on the ram nose between the punch nose and the ram body.

Illustration 4. The ironing system of any preceding or subsequent illustrations or combination of illustrations, wherein the punch nose is coupled to the sensor.

Illustration 5. The ironing system of any preceding or subsequent illustrations or combination of illustrations, wherein a gap is defined between the punch nose and the punch sleeve.

Illustration 6. The ironing system of any preceding or subsequent illustrations or combination of illustrations, further comprising a punch sleeve retention nut, wherein the punch sleeve retention nut is coupled to an outer surface of the ram nose such that at least a portion of the punch sleeve is retained on the ram nose between the punch sleeve retention nut and the ram body.

Illustration 7. The ironing system of any preceding or subsequent illustrations or combination of illustrations, wherein the inner surface of the ram comprises a shoulder, and wherein the ironing system further comprises an adaptor nut coupled to the inner surface of the ram such that a portion of the adaptor is retained between the adaptor nut and the shoulder.

Illustration 8. An ironing system comprising: a ram comprising a ram body and a ram nose; a punch comprising a punch nose and a punch sleeve, wherein the punch nose is configured to engage a metal blank during an ironing process; and a sensor system comprising a sensor coupled to the punch nose, wherein the sensor is configured to detect a force on the punch nose during the ironing process.

Illustration 9. The ironing system of any preceding or subsequent illustrations or combination of illustrations, further comprising a punch sleeve retention nut coupled to an outer surface of the ram nose, wherein the punch sleeve is supported on the ram nose between the punch sleeve retention nut and the ram body.

Illustration 10. The ironing system of any preceding or subsequent illustrations or combination of illustrations, wherein the ram comprises an inner surface defining an inner chamber, wherein the sensor is supported in the inner chamber, and wherein the punch nose is threadably coupled with the sensor.

Illustration 11. The ironing system of any preceding or subsequent illustrations or combination of illustrations, wherein the sensor system further comprises an adaptor, the ram comprises an inner surface defining an inner chamber, wherein the sensor is supported on the adaptor, and wherein the adaptor is coupled with the inner surface of the ram in the inner chamber.

Illustration 12. The ironing system of any preceding or subsequent illustrations or combination of illustrations, wherein the adaptor comprises a central aperture and a plurality of passages surrounding the central aperture, wherein the sensor is supported in the central aperture of the adaptor, and wherein each of the plurality of passages extends along a length of the adaptor.

Illustration 13. The ironing system of any preceding or subsequent illustrations or combination of illustrations, wherein the sensor is indirectly connected to the ram nose.

Illustration 14. The ironing system of any preceding or subsequent illustrations or combination of illustrations, wherein the sensor is coupled to the punch nose such that a gap is defined between the punch nose and the punch sleeve.

Illustration 15. An ironing system comprising: a ram comprising a ram body and a ram nose, wherein the ram comprises an inner surface defining an inner chamber; a sensor system comprising a sensor; and a punch nose connected to the inner surface on the ram nose via the sensor, wherein the sensor is configured to detect a force on the punch nose during an ironing process.

Illustration 16. The iron system of any preceding or subsequent illustrations or combination of illustrations, wherein the sensor system further comprises an adaptor, wherein the adaptor supports the sensor, and wherein the adaptor is coupled to the inner surface of the ram.

Illustration 17. The ironing system of any preceding or subsequent illustrations or combination of illustrations, wherein the adaptor comprises a central aperture and a plurality of passages surrounding the central aperture, wherein the sensor is supported in the central aperture of the adaptor, and wherein each of the plurality of passages extends along a length of the adaptor.

Illustration 18. The ironing system of any preceding or subsequent illustrations or combination of illustrations, wherein the inner surface of the ram comprises a shoulder, and wherein the ironing system further comprises an adaptor nut coupled to the inner surface of the ram such that a portion of the adaptor is retained between the adaptor nut and the shoulder.

Illustration 19. The ironing system of any preceding or subsequent illustrations or combination of illustrations, further comprising a punch sleeve supported on the ram nose between the punch nose and the ram body, wherein the punch nose is connected to the sensor such that a gap is defined between the punch sleeve and the punch nose.

Illustration 20. The ironing system of any preceding or subsequent illustrations or combination of illustrations, further comprising a punch sleeve retention nut connected to the ram nose such that at least a portion of the punch sleeve is retained on the ram nose between the punch sleeve retention nut and the ram body.

The above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed:

1. A can forming system comprising:

a ram comprising a ram body and a ram nose, wherein the ram comprises an inner surface defining an inner chamber; and a sensor system comprising:

a sensor, wherein the sensor is configured to detect a force during a can forming process; and an adaptor coupled to the inner surface of the ram, wherein the adaptor supports the sensor on the ram body, wherein the adaptor comprises a central aperture and a plurality of passages surrounding the central aperture, wherein the sensor is supported in the central aperture of the adaptor, and wherein each of the plurality of passages extends along a length of the adaptor.

2. The can forming system of claim 1, further comprising a punch supported on the ram nose, wherein the punch comprises a punch nose and a punch sleeve, wherein the punch nose is configured to engage a metal blank during processing, and wherein the punch sleeve is supported on the ram nose between the punch nose and the ram body.

3. The can forming system of claim 2, wherein the punch nose is coupled to the sensor.

4. The can forming system of claim 3, wherein a gap is defined between the punch nose and the punch sleeve.

5. The can forming system of claim 2, further comprising a punch sleeve retention nut, wherein the punch sleeve retention nut is coupled to an outer surface of the ram nose such that at least a portion of the punch sleeve is retained on the ram nose between the punch sleeve retention nut and the ram body.

6. The can forming system of claim 1, wherein the inner surface of the ram comprises a shoulder, and wherein the forming system further comprises an adaptor nut coupled to the inner surface of the ram such that a portion of the adaptor is retained between the adaptor nut and the shoulder.

7. A can forming system comprising:

a ram comprising a ram body and a ram nose;

a punch comprising a punch nose and a punch sleeve, wherein the punch nose is configured to engage a metal blank during a can forming process;

a sensor system comprising a sensor coupled to punch nose, wherein the sensor is configured to detect a force on the punch nose during the can forming process; and an adaptor, the ram comprises an inner surface defining an inner chamber, wherein the sensor is supported on the adaptor, and wherein the adaptor is coupled with the inner surface of the ram in the inner chamber, wherein the adaptor comprises a central aperture and a plurality of passages surrounding the central aperture, wherein the sensor is supported in the central aperture of the adaptor, and wherein each of the plurality of passages extends along a length of the adaptor.

8. The can forming system of claim 7, further comprising a punch sleeve retention nut coupled to an outer surface of the ram nose, wherein the punch sleeve is supported on the ram nose between the punch sleeve retention nut and the ram body.

9. The can forming system of claim 7, wherein the ram comprises an inner surface defining an inner chamber, wherein the sensor is supported in the inner chamber, and wherein the punch nose is threadably coupled with the sensor.

10. The can forming system of claim 7, wherein the sensor is indirectly connected to the ram nose.

11. The can forming system of claim 7, wherein the sensor is coupled to the punch nose such that a gap is defined between the punch nose and the punch sleeve.

12. A can forming system comprising:

a ram comprising a ram body and a ram nose, wherein the ram comprises an inner surface defining an inner chamber;

a sensor system comprising a sensor; and a punch nose connected to the inner surface of the ram on the ram nose via the sensor, wherein the sensor is configured to detect a force on the punch nose during a can forming process, wherein the sensor system further comprises an adaptor, wherein the adaptor supports the sensor, and wherein the adaptor is coupled to the inner surface of the ram, wherein the adaptor comprises a central aperture and a plurality of passages surrounding the central aperture, wherein the sensor is supported in the central aperture of the adaptor, and wherein each of the plurality of passages extends along a length of the adaptor.

13. The can forming system of claim 12, wherein the inner surface of the ram comprises a shoulder, and wherein the forming system further comprises an adaptor nut coupled to the inner surface of the ram such that a portion of the adaptor is retained between the adaptor nut and the shoulder.

14. The can forming system of claim 12, further comprising a punch sleeve supported on the ram nose between the punch nose and the ram body, wherein the punch nose is connected to the sensor such that a gap is defined between the punch sleeve and the punch nose.

15. The can forming system of claim 14, further comprising a punch sleeve retention nut connected to the ram nose such that at least a portion of the punch sleeve is retained on the ram nose between the punch sleeve retention nut and the ram body.

* * * * *